US006544069B1

(12) United States Patent
Enriquez, Sr. et al.

(10) Patent No.: US 6,544,069 B1
(45) Date of Patent: Apr. 8, 2003

(54) SWIVEL OUTLET

(76) Inventors: Leonardo Enriquez, Sr., 15340 SW. 72nd Ave., Miami, FL (US) 33157; Leonard N. Enriquez, 15340 SW. 72nd Ave., Miami, FL (US) 33157

( * ) Notice: Subject to any disclaimer, the term of this patent is extended or adjusted under 35 U.S.C. 154(b) by 0 days.

(21) Appl. No.: 09/967,599

(22) Filed: Sep. 28, 2001

(51) Int. Cl.[7] ..... H01R 13/60
(52) U.S. Cl. ..... 439/534; 459/6; 459/8
(58) Field of Search ..... 439/11, 8, 17, 439/536, 6, 9, 131, 534; 174/67

(56) References Cited

U.S. PATENT DOCUMENTS 1,973,234 A * 9/1934 Tsavaris ..... 439/17
2,362,100 A * 11/1944 Schwartz ..... 174/86
2,652,546 A * 9/1953 Christner ..... 439/651
3,092,695 A * 6/1963 Abrams ..... 200/51 R
3,328,741 A * 6/1967 Brown ..... 280/422
4,138,177 A * 2/1979 Van Valer ..... 191/12.4
4,237,342 A * 12/1980 Eller et al. ..... 379/332
4,382,647 A * 5/1983 Paley ..... 361/813
4,405,877 A * 9/1983 Haraden et al. ..... 313/318.01
4,660,906 A * 4/1987 Haraden ..... 439/11
5,035,646 A * 7/1991 Ehrenfels et al. ..... 248/906
5,159,168 A * 10/1992 Portmann et al. ..... 219/81
5,211,570 A * 5/1993 Bitney ..... 439/320
5,249,970 A * 10/1993 Jennings ..... 439/11
5,384,428 A * 1/1995 Luu ..... 174/66
5,578,795 A * 11/1996 Ward ..... 15/314
5,683,254 A * 11/1997 Lin ..... 362/226
5,886,299 A * 3/1999 Ward ..... 174/66
5,997,310 A * 12/1999 Chiu et al. ..... 439/11
6,093,028 A * 7/2000 Yang ..... 362/226
6,186,796 B1 * 2/2001 Wedge ..... 340/949
6,190,180 B1 * 2/2001 Purington et al. ..... 439/17
6,273,734 B1 * 8/2001 Ikeda et al. ..... 439/131
6,309,249 B1 * 10/2001 Didehvar et al. ..... 362/266

* cited by examiner

*Primary Examiner*—Tho D. Ta
*Assistant Examiner*—Edwin A. León
(74) *Attorney, Agent, or Firm*—J. Sanchelima; A. Bordas

(57) ABSTRACT

A swivel-type electrical outlet primarily including an outlet assembly, casing and mounting assembly. The outlet assembly has an outlet ball approximately spherical in shape, with imbedded stranded cable pigtails. The swivel-type outlet may return to a neutral position after a user pulls an electrical cord from an angle not directly perpendicular to the receptacle, since the outlet ball may swivel perpendicularly to the direction of the electrical cord pull. The casing accommodates the outlet and has a smooth internal surface to allow easy movement of the outlet ball. An elastic diaphragm, secured behind the outlet ball to the mounting assembly, forces the outlet ball back to its neutral position after the electrical plug has been disconnected. The mounting assembly supports the casing and is secured to a typical junction box.

8 Claims, 3 Drawing Sheets

SWIVEL OUTLET

BACKGROUND OF THE INVENTION

1. Field of the Invention

The present invention relates to electrical outlets, and more particularly, introduces a swivel-type electrical outlet.

2. Description of the Related Art

Electrical outlets are common in most buildings, including residences and in equipment, and have been utilized for some time. All existing outlets are of the rigid-type or fixed type. However, rigid-type electrical outlets have a common drawback. The defect occurs when a plug from an electrical cord is repeatedly pulled from an outlet with a force in a direction not perpendicular to a receptacle. The pulling force causes deformation and sometimes breakage of associated electrical plug blades. Once deformed, several problems may occur. It frequently becomes impossible to insert the plug blades into an outlet unless the plug blades are first straightened out. Bent or damaged plug blades typically do not properly align with internal contact surfaces of the electrical outlet. In addition, sometimes the whole outlet assembly is pulled out from its normal position within a junction box. This condition creates the possibility of an electrical shock while plugging and unplugging a badly damaged, stuck plug. Once the plug blades become damaged or deformed, they should be immediately replaced. However, often they are not. Once the plug blades are deformed and repeatedly fixed or straightened out, they become brittle and usually break up while inserting or removing the electrical plug into or out of an outlet, thus creating the possibility of an electrical shock. This is especially true if a piece of a plug blade remains inside the outlet.

Many designs for fixed-type electrical outlets have been designed in the past. None of them, however, include an outlet assembly to prevent the deformation or breakage of associated electrical plug blades when an electrical plug is repeatedly pulled from an electrical outlet in a direction not perpendicular to the receptacle.

There are no similar swivel outlets to the best of applicant's knowledge that include an outlet assembly to prevent the deformation and breakage of associated electrical plug blades.

SUMMARY OF THE INVENTION

The instant invention is a swivel outlet that may swivel in the direction of which an electrical cord is pulled.

The instant invention is ergonomically designed to allow a user to safely remove an electrical plug from an electrical outlet, without having to bend down or reach sideways to the position of the electrical outlet. The user may simply pull the electrical cord from a more convenient, comfortable and safe position, thus avoiding possible painful back strains. An acceptable deviation of the pulling force direction may be within a solid angle of approximately 30 degrees. This means that at a distance of five feet from the outlet, there is an available area of more than two feet in diameter, within which the electrical cable may be pulled without placing an undue strain on the plug blades. Said invention is favorable even for 90-degree lugs when compared with unplugging from fixed-type outlets.

In the preferred embodiment, the present invention is mostly applied to typical domestic-duty type outlets. Other embodiments of said invention are also applicable for medium-duty and heavy-duty outlets. Applicability of said invention is independent from blade layouts, number of blades, blade shapes or ampere ratings. However, said invention is not applicable for those outlets requiring a twist action to be plugged and unplugged where the plug blades are configured to cooperatively lock to an outlet.

In an embodiment, said invention consists of a single outlet per junction box. However, said invention obviously may be implemented to any number of outlets per outlet combination or grouping scheme, as no more space is needed to install the swivel-type outlets. The design of the instant invention is consistent with realistic, serial type, manufacturing techniques incorporated within the standards of Underwriters Laboratories Inc. ("UL"), an independent, not-for-profit product safety testing and certification organization, and the National Electrical Manufacturers Association ("NEMA") standards observed by existing fixed-type electrical outlets.

The instant invention comprises a receptacle allowing angular movement around an axis of the receptacle when forced by a user. This reduces the possibility that blades from an electrical cord housing will be bent, whereby the receptacle has elastic means to return said receptacle to a neutral position.

More specifically, the instant invention comprises an outlet assembly with first and second ends, said first end having a receptacle with slots to receive plug blades. The second end is hollow to receive electrical wiring therethrough that corresponds and connects to said slots. The receptacle has an outlet side face angularly extending a first predetermined distance from said first end towards said second end. The outlet assembly further includes an outlet ball disposed between said first and second ends extending from said outlet side face. The outlet ball has a longitudinal outlet neck extending to said second end. The outlet neck has a groove at a second predetermined distance from said second end.

Said invention further comprises a case assembly having first and second case sections partially housing said outlet assembly. The first case section has a first through opening for receiving said outlet neck and a bowl extending from said first through opening. The first case section further includes at least one protrusion with a unique shape axially mounted thereon. The second case section has a second through opening for said receptacle to protrude. The second through opening has a first angular rim, and includes at least one slot with mating cooperative characteristics to receive said protrusion. The outlet side face coacts against said angular rim when biased; thereby restricting angular travel of said outlet assembly.

In addition, a mounting assembly housing said case assembly and having a third through opening for said outlet neck and further comprising mounting straps. The instant invention has means for angularly swiveling said outlet assembly. Said means includes a diaphragm centrally disposed and secured to said third through opening and mounted to said groove. The diaphragm may be made of rubber or a material having similar elastic characteristics. The diaphragm has cooperative dimensions to coact with said outlet assembly. A user exerting an outwardly and angular force when pulling on an electrical cord, not perpendicular to said receptacle in a neutral position, overcomes a force of said diaphragm, may remove said plug blades, whereas said diaphragm flexes and selectively causes said outlet assembly to return to said neutral position after said plug blades are removed.

A cover plate has a fourth through opening for said receptacle. The fourth through opening has a second angular rim to cooperatively coact with said first angular rim. Further comprising is a junction box to house said mounting assembly, whereas said cover plate covers said second case section while leaving said receptacle exposed.

In one embodiment, the first and second angular rims are up to thirty-five degrees. In an alternate embodiment, said first and second angular rims are between twenty-five and thirty-five degrees.

It is therefore one of the main objects of the present invention to provide a swivel outlet that prevents the deformation and breakage of associated electrical plug blades.

It is another object of this invention to provide a swivel outlet that may swivel to a neutral position after an electrical cord has been pulled from a direction not perpendicular to the swivel outlet.

It is another object of this invention to provide a swivel outlet that is ergonomically designed to prevent back strains to the user.

It is still another object of the present invention to provide a swivel outlet that is applied to typical domestic-duty type outlets.

It is still another object of the present invention to provide a swivel outlet that is also applicable to medium-duty and heavy-duty outlets.

It is yet another object of the present invention to provide a swivel outlet that is applicable, regardless of blade layouts, blade shapes or ampere ratings.

It is yet another object of this invention to provide such a device that may be equally or less costly to manufacture and maintain as an equivalent fixed-type outlet, while retaining its expected effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 2:
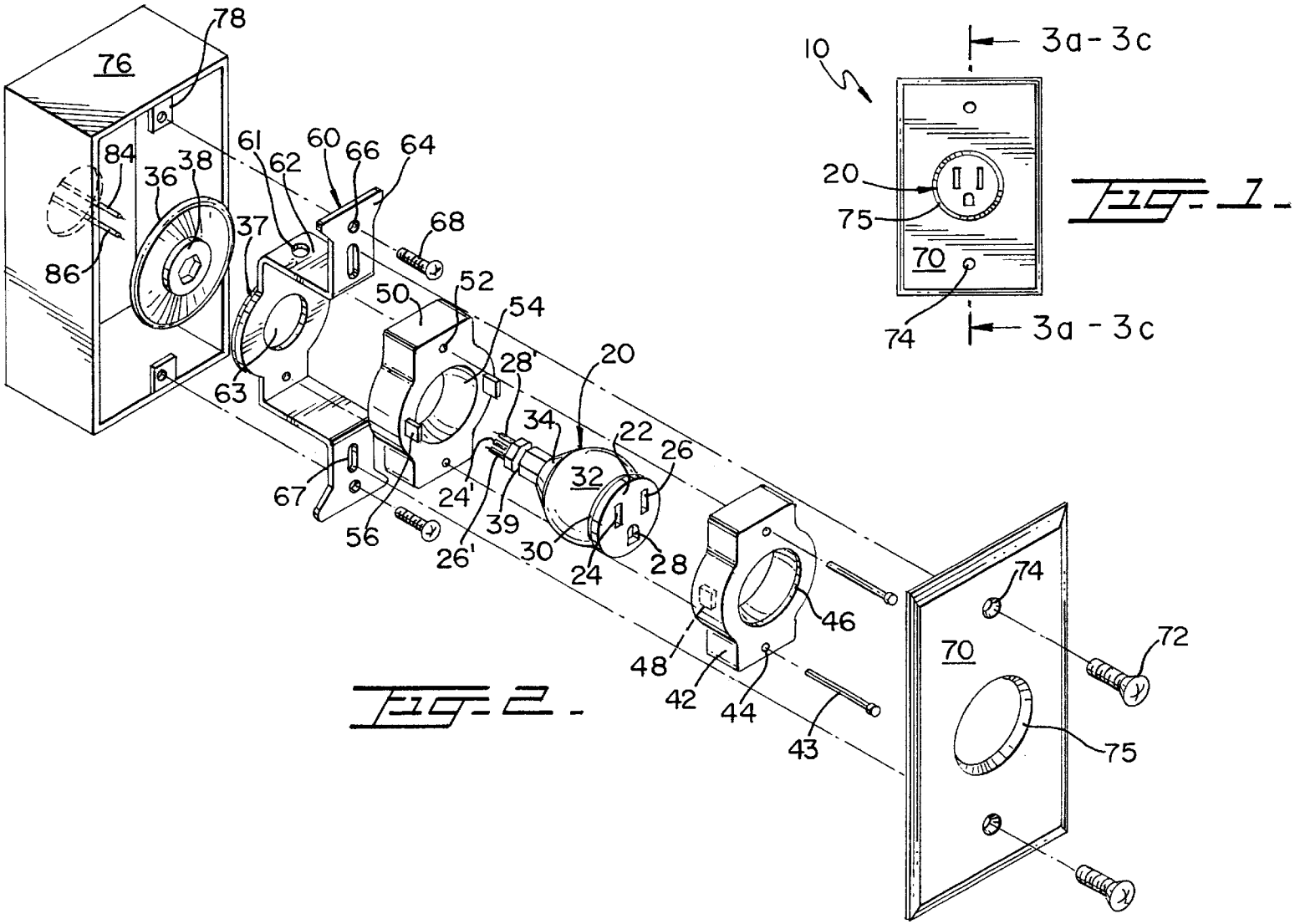
FIG. 1 shows an elevation view of the instant invention.
FIG. 2 shows an exploded view of said invention.

Referring now to the drawings, where the present invention is generally referred to with numeral 10, it can be observed that it basically includes outlet assembly 20, case assembly 40, and mounting assembly 60.

As seen in FIG. 1, instant invention 10 resembles a typical electrical outlet. Outlet assembly 20 is approximately flush with cover plate 70. Cover plate 70 has through holes 74 and rim 75 at an angle to allow outlet assembly 20 to swivel.

As seen in FIG. 2, case assembly 40 primarily comprises case sections 42 and 50. Case sections 42 and 50 together partially house outlet assembly 20 and are generally shaped as shown in FIG. 2, in the preferred embodiment. Case section 50 has case bowl 54 on one face, a smooth internal bowl like surface to accommodate and allow easy movement of outlet ball 32. Case section 50 has tabs 56, which are of complementary dimension to case slots 48 of case section 42. Case section 50 also has through holes 52, which are located at opposite ends in the preferred embodiment. Case section 42 has through holes 44, which align with through holes 52 when case sections 42 and 50 are fitted together and riveted to mounting member 62. On one face, case section 42 has case rim 46. Case rim 46 is angled to complement outlet side face 30.

Outlet assembly 20 is an electrical outlet having receptacle 22. Receptacle 22, as a standard outlet, has hot slot 24, neutral slot 26, and ground slot 28. Angularly extending and reducing in outside diameter is outlet side face 30. In the preferred embodiment, outlet side face 30 is angled approximately 30 degrees from receptacle 22 and complements the shape of case rim 46. Extending from outlet side face 30 is outlet ball 32, which connects to outlet neck 34. Near the end of outlet neck 34 is groove 39. Groove 39 receives internal diaphragm ring 38 when set upon it.

Mounting assembly 60 primarily comprises mounting member 62 and mounting straps 64, which extend in opposite directions from one edge of mounting member 62. Mounting member 62 has a rear face with hole 63 there through. Diaphragm 36 is generally circular and of cooperative dimensions to hole 63. Internal diaphragm ring 38 defines the central area of diaphragm 36 and is of cooperative dimension to mount onto groove 39. Diaphragm 36 is made of a rubber composition in the preferred embodiment, however other elastic or flexible materials may be utilized with similar characteristics. The outside diameter of diaphragm 36 is of cooperative dimensions to sit snugly within hole 63. Mounting straps 64 have though-holes 66 and nut plates 67. Mounting member 62 is generally rectangular in shape and snugly houses case assembly 40.

Junction box 76 is a typical junction box that houses outlets. Mounting tabs 78 extend from junction box 76 to secure an outlet thereon. Cover plate 70 has rim 75 centrally disposed therethrough. Rim 75 complements the angle of case rim 46 to allow angular movement of outlet assembly 20. Through-holes 74 allow cover plate screws 72 to trespass and secure onto nut plates 67 of mounting straps 64. Hot wire 84 and neutral wire 86 connect to hot wire 24' and neutral wire 26' respectively.

To assemble instant invention 10, outlet assembly 20 is positioned onto case section 50 so that outlet ball 32 sits upon case bowl 54. Case section 42 is aligned with case section 50 to enable tabs 56 to insert into case slots 48. Once removably secured to one another, case assembly 40 is fitted within mounting member 62. Rivets 43 trespass through-holes 44 and 52 to secure onto the rear face of mounting member 62. Once case assembly 40 is secure to mounting member 62, internal diaphragm ring 38 is pressed onto groove 39 of outlet neck 34. Mounting screws 68 secure mounting assembly 60 to a typical junction box, such as junction box 76. Through-holes 74 of cover plate 70 are then aligned with nut plates 67 and cover plate screws 72 are fastened.

Figure 3A:
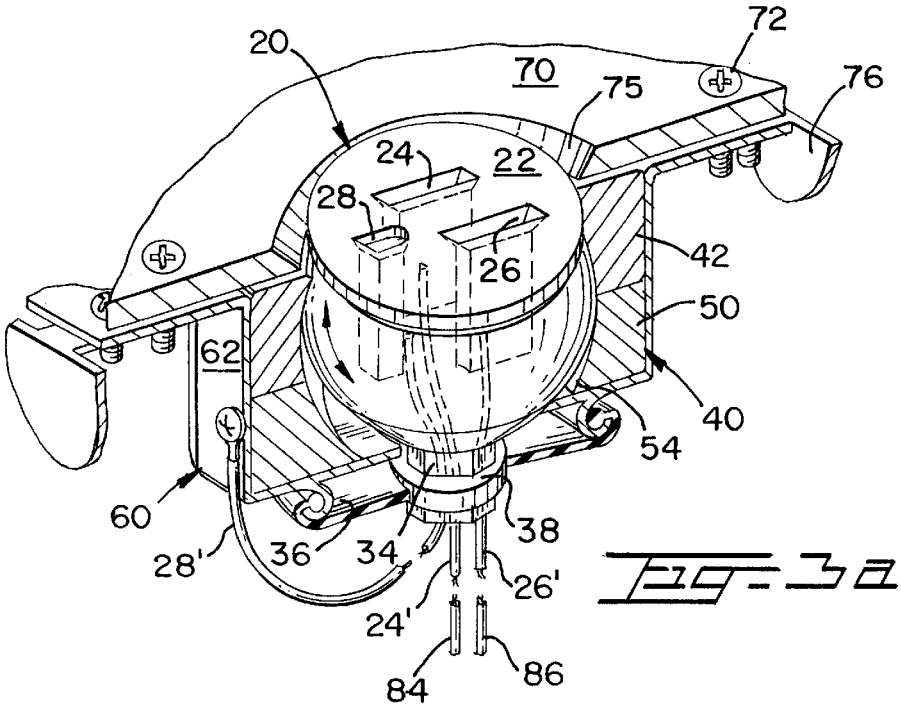
FIG. 3*a* represents a sectional isometric view of the instant invention.

As seen in FIG. 3*a,* receptacle 22 has hot slot 24, neutral slot 26, and ground slot 28, which receive plug blades, not seen. Extending from hot slot 24, neutral slot 26, and ground slot 28 are hot wire 24', neutral wire 26', and ground wire 28' respectively. Hot wire 24', neutral wire 26', and ground wire 28' extend through outlet neck 34. As seen, outlet assembly 20 is in the neutral position, whereas receptacle 22 is parallel to cover plate 70. Partially housing outlet assembly 20 is case assembly 40. Case assembly 40 has case sections, 42 and 50, which join to contain outlet ball 32 within.

Figure 3B:
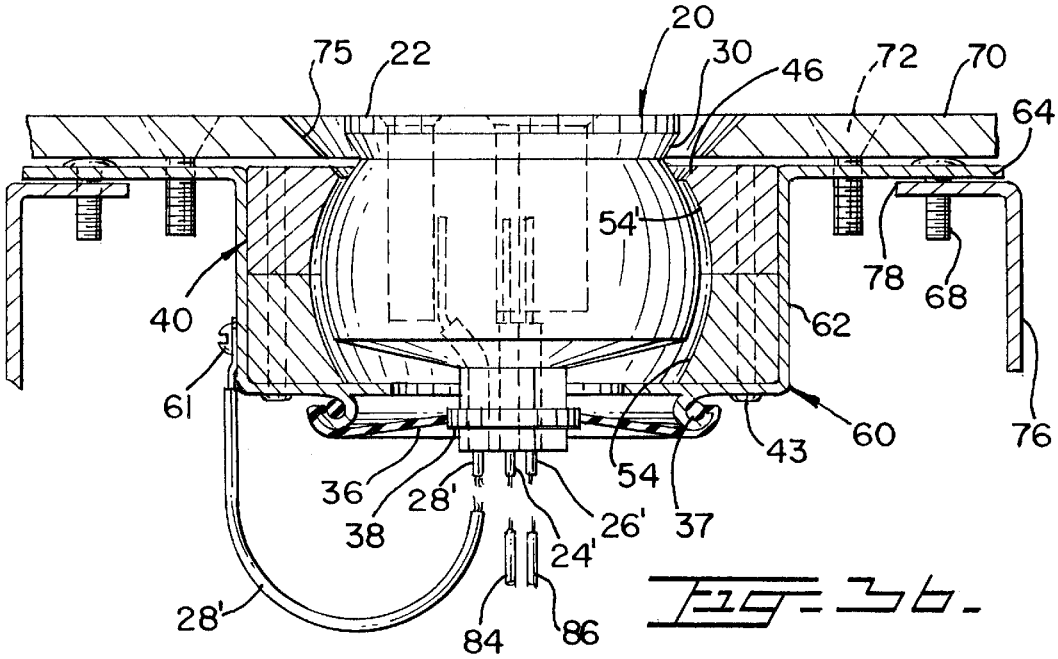
FIG. 3*b* shows a side elevation view of the instant invention.

As seen in FIG. 3*b,* outlet assembly 22 is in the neutral position. Cover plate 70 is secured to mounting straps 64 with cover plate screws 72. As best seen, case sections 42 and 50 have case bowls 54' and 54 respectively. Case bowls 54' and 54 have sufficient space to allow outlet ball 32 to smoothly swivel within. Rivets 43 trespass case sections 42 and 50 to secure to mounting member 62. Mounting screws 68 secure mounting straps 64 to junction box 76. Ground wire 28' secures to ground screw 61. Ground screw 61 is secured to mounting assembly 60. Mounting member 62 has groove 37 that curves therefrom for the edge of diaphragm 36 to within. Groove 37 is of cooperative dimensions to secure diaphragm 36 and prevent it from dislodging.

Figure 3C:
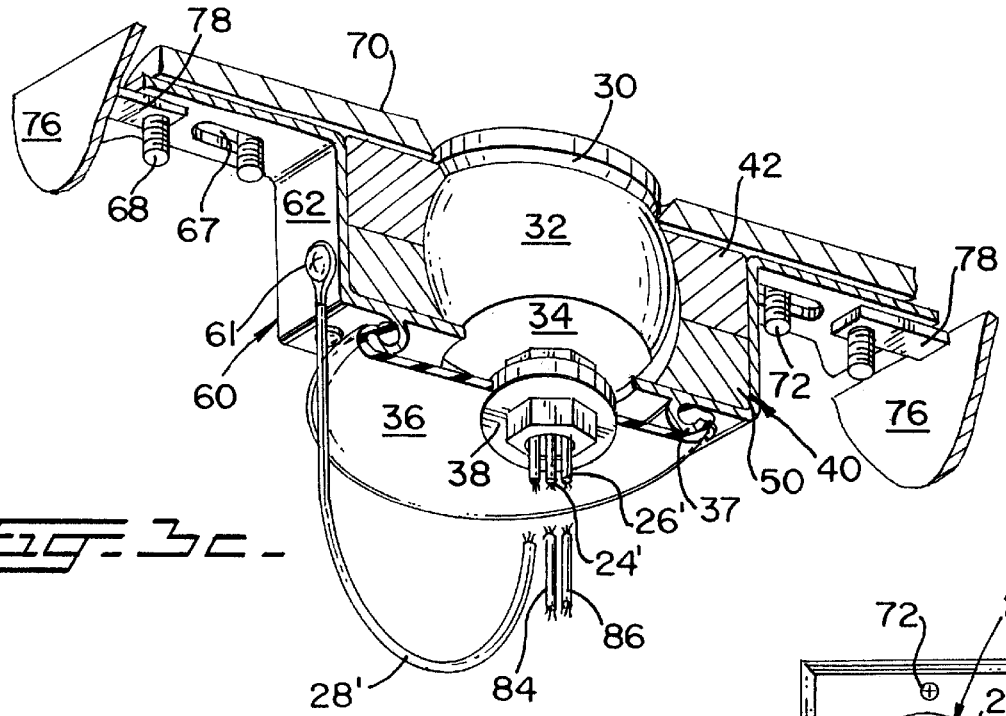
FIG. 3*c* shows an isometric bottom view of the instant invention.

As seen in FIG. 3*c,* the entire outside edge of diaphragm 36 is secured within groove 37. Diaphragm 36 forces outlet ball 32 back to its neutral position after an electrical cord has been disconnected.

Figure 4:
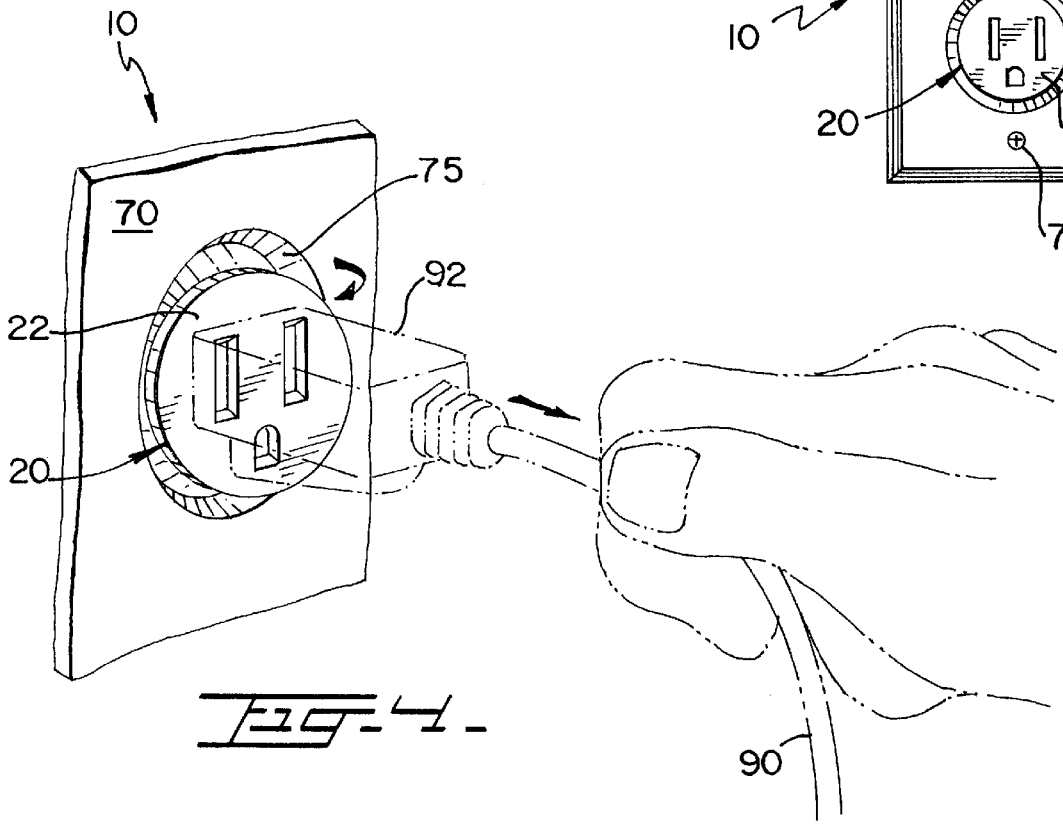
FIG. 4 illustrates a perspective view of the outlet ball at an angle when an electrical cord is being removed.

As seen in FIG. 4, electrical cord 90 terminates at one end with housing 92, which is plugged into outlet assembly 20. As shown, outlet assembly 20 swivels in the direction that electrical cord 90 is pulled from. Once the plug blades secured to housing 92, not seen, are removed from receptacle 22, outlet assembly 20 returns to its neutral position.

Figure 5:
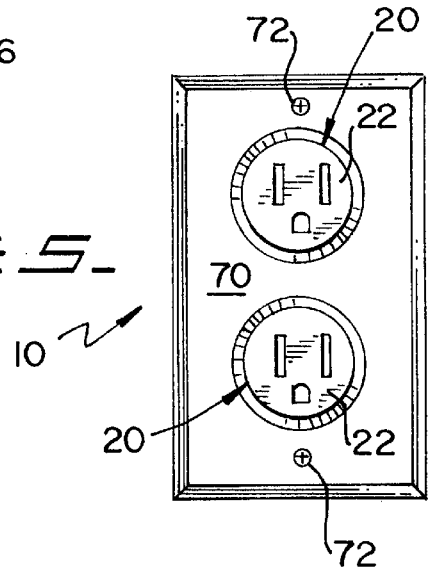
FIG. 5 illustrates an alternate embodiment of the instant invention.

Seen in FIG. 5 is one alternate embodiment of instant invention 10, where a plurality of outlet assemblies 20 are present and cooperate with cover plate 70.

The use of factory-wired, stranded, insulated cable pigtails of appropriate length, provide adequate flexibility and facilitate connections to a fixed wiring installation.

In one embodiment, the permanent connection of a green-insulated grounding pigtail to mounting member 62 at the captive ground screw 61 indicates where a usual fixed-installation grounding wire is typically connected and, or to one of two assembly rivets or additional equipment ground terminals.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An electrical swivel outlet, comprising:

A) an outlet assembly with first and second ends, said first end having a receptacle with slots to receive plug blades and said second end being hollow to receive electrical wiring therethrough that corresponds and connects to said slots, said receptacle having an outlet side face angularly extending a first predetermined distance from said first end towards said second end, said outlet assembly further includes an outlet ball disposed between said first and second ends extending from said outlet side face, said outlet ball having a longitudinal outlet neck extending to said second end, said outlet neck having a groove at a second predetermined distance from said second end;

B) a case assembly having first and second case sections partially housing said outlet assembly, said first case section having a first through opening for receiving said outlet neck and a bowl extending from said first through opening, said first case section further including at least one protrusion with a unique shape axially mounted thereon, said second case section having a second through opening for said receptacle to protrude, said second through opening having a first angular rim, and including at least one slot with mating cooperative characteristics to receive said protrusion, said outlet side face coacts against said angular rim when biased, thereby restricting angular travel of said outlet assembly;

C) a mounting assembly housing said case assembly and having a third through opening for said outlet neck and further comprising mounting straps; and D) means for angularly swiveling said outlet assembly.

2. The electrical swivel outlet set forth in claim 1, wherein said means includes a diaphragm centrally disposed and secured to said third through opening and mounted to said groove, said diaphragm having cooperative dimensions to coact with said outlet assembly so that a user exerting an outwardly and angular force when pulling on an electrical cord, not perpendicular to said receptacle in a neutral position, to overcome a force of said diaphragm, and removing said plug blades, said diaphragm flexes and selectively causing said outlet assembly to return to said neutral position after said plug blades are removed.

3. The electrical swivel outlet set forth in claim 2, further comprising a cover plate having a fourth through opening for said receptacle, said fourth through opening having a second angular rim to cooperatively coact with said first angular rim.

4. The electrical swivel outlet set forth in claim 3, further comprising a junction box to house said mounting assembly whereas said cover plate covers said second case section while leaving said receptacle exposed.

5. The electrical swivel outlet set forth in claim 4, whereas said first and second angular rims are up to thirty-five degrees.

6. The electrical swivel outlet set forth in claim 5, whereas said diaphragm is elastic.

7. The electrical swivel outlet set forth in claim 4, whereas said first and second angular rims are between twenty-five and thirty-five degrees.

8. The electrical swivel outlet set forth in claim 7, whereas said diaphragm is elastic.

* * * * *

UNITED STATES PATENT AND TRADEMARK OFFICE

CERTIFICATE OF CORRECTION

PATENT NO. : 6,544,069 B1
DATED : April 8, 2003
INVENTOR(S) : Leonardo Enriques Sr. et al.

It is certified that error appears in the above-identified patent and that said Letters Patent is hereby corrected as shown below:

Title page,
Item [73], Assignee:, add item:
-- Engineered Patents, Inc., Miami, FL --

Signed and Sealed this

Second Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,544,069 B1
DATED : April 8, 2003
INVENTOR(S) : Leonardo Enriquez Sr. et al.

It is certified that error appears in the above-identified patent and that said Letters Patent is hereby corrected as shown below:

Title page,
Item [73], Assignee:, add item:
-- Engineered Patents, Inc., Miami, FL --

This certificate supersedes Certificate of Correction issued September 2, 2003.

Signed and Sealed this

Twentieth Day of January, 2004

JON W. DUDAS
*Acting Director of the United States Patent and Trademark Office*